US008431758B2

(12) United States Patent
Frey et al.

(10) Patent No.: US 8,431,758 B2
(45) Date of Patent: Apr. 30, 2013

(54) PROCESSES FOR INCREASING THE OVERALL AROMATICS AND XYLENES YIELD IN AN AROMATICS COMPLEX

(75) Inventors: Stanley J. Frey, Palatine, IL (US); Jason T. Corradi, Arlington Heights, IL (US); Gregory Werba, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 324 days.

(21) Appl. No.: 12/883,977

(22) Filed: Sep. 16, 2010

(65) Prior Publication Data

US 2012/0067774 A1 Mar. 22, 2012

(51) Int. Cl.
*C07C 2/66* (2006.01)
*C07C 5/27* (2006.01)

(52) U.S. Cl.
USPC ..... 585/319; 585/470; 585/474; 585/477

(58) Field of Classification Search ..... 585/319, 585/470, 474, 477
See application file for complete search history.

(56) References Cited

U.S. PATENT DOCUMENTS 4,211,886 A * 7/1980 Tabak et al. ..... 585/321
4,551,228 A 11/1985 Ramella et al.
4,885,422 A 12/1989 Wang
5,380,425 A 1/1995 Child et al.
6,004,452 A 12/1999 Ash et al.
6,972,347 B1 12/2005 Kitamura et al.
7,686,946 B2 3/2010 Zhou
7,727,490 B2 6/2010 Zhou

OTHER PUBLICATIONS

Lacrosse, T., et al., BTX production: Flexibility through modern UOP [Inc] Technology, Hydrocarbon Technology International (ISSN 0952-1399) 125-28 (1993) Sterling Publications.

* cited by examiner

*Primary Examiner* — Thuan D Dang
(74) *Attorney, Agent, or Firm* — Mark R Willis

(57) ABSTRACT

Processes for increasing overall aromatics and xylenes yield in an aromatics complex are provided. A $C_8$+ aromatics stream from an aromatics-rich reformate is separated into a $C_8$ aromatics fraction and a $C_9$+ aromatics fraction comprising higher alkyl group-substituted $C_9$ and $C_{10}$ aromatics. The $C_9$+ aromatics fraction is separated into a lighter boiling, higher alkyl group-substituted $C_9$ or $C_9/C_{10}$ aromatics fraction and a heavier boiling, $C_{10}$+ or $C_{11}$+ aromatics fraction. The lighter boiling, higher alkyl group-substituted $C_9$ or $C_9/C_{10}$ aromatics fraction is isomerized to convert a portion of the higher alkyl group-substituted $C_9$ or $C_9/C_{10}$ aromatics therein into methyl-enriched $C_9$ aromatics or methyl-enriched $C_9/C_{10}$ aromatics. The methyl-enriched $C_9$+ aromatics stream comprising the methyl-enriched C9+ aromatics stream or the methyl-enriched $C_9/C_{10}$ aromatics is transalkylated with a toluene-containing stream.

4 Claims, 6 Drawing Sheets

PROCESSES FOR INCREASING THE OVERALL AROMATICS AND XYLENES YIELD IN AN AROMATICS COMPLEX

FIELD OF THE INVENTION

The present invention generally relates to aromatics production, and more particularly relates to processes for increasing the overall aromatics and xylenes yield in an aromatics complex.

DESCRIPTION OF RELATED ART

An aromatics complex is a combination of process units that are used to convert naphtha, from a variety of sources, and pyrolysis gasoline into the basic petrochemical intermediates, benzene, toluene, and mixed xylenes. In aromatics applications, the naphtha is generally restricted to $C_6$+ compounds to maximize the production of benzene, toluene, and xylenes. The majority of the mixed xylenes are processed further within the aromatics complex, in a xylenes recovery section, to produce one or more individual aromatic isomers. As used herein, "mixed xylenes" contain four different $C_8$ aromatic isomers, including para-xylene which is used for the production of polyester fibers, resins and films.

Additional mixed xylenes may be produced from toluene, which is of low value, and heavy aromatics ($C_9$+ aromatics) (also referred to hereinafter as "heavies") that are present in reformate from the naphtha feedstock. Reformate is produced by selectively reforming the naphtha feedstock, in the presence of a reforming catalyst, to aromatics and high purity hydrogen. The naphtha feedstock is first hydrotreated to remove sulfur and nitrogen compounds and then sent to a reforming unit. In the reforming unit, paraffins and naphthenes in the naphtha feedstock are converted to aromatics, with as little aromatic ring opening or cracking as possible, producing "catalytically reformed naphtha".

To produce additional mixed xylenes from the low-value toluene and heavy aromatics ($C_9$+ aromatics), the aromatics complex may include a transalkylation process unit that is integrated between an aromatics fractionation section and the xylenes recovery section of the aromatics complex. The two major reactions in the transalkylation process unit are disproportionation and transalkylation. The conversion of toluene into benzene and mixed xylenes is called toluene disproportionation. Transalkylation is the conversion of a mixture of toluene, $C_9$ aromatics ($A_9$s), and $C_{10}$ aromatics ($A_{10}$s) into benzene and mixed xylenes. The process reactions are conducted in a hydrogen atmosphere to minimize coke formation on a transalkylation catalyst. As there is negligible aromatic ring destruction during the process, there is very little hydrogen consumption as a result of these reactions.

The catalytically reformed naphtha and pyrolysis gasoline feedstocks contain a large amount of phenyl groups substituted with ethyl, propyl, and butyl groups (collectively referred to herein as "higher alkyl groups"). Unfortunately, alkyl groups larger than methyl are cracked off of the phenyl group during transalkylation. "Dealkylation" refers to the complete or partial removal of the alkyl group(s). The scission of these higher alkyl groups leads to higher fuel gas yield, and higher benzene rather than more valuable para-xylene yield relative to the equivalent carbon number aromatic that had greater methyl group substitution. In addition, most of the hydrogen that is consumed during disproportionation and transalkylation is attributable to the cracking of non-aromatic impurities in the feedstock and such dealkylation of the ethyl, propyl, and butyl groups from the $C_9$ and $C_{10}$ aromatics.

Accordingly, it is desirable to provide processes for increasing overall aromatics and xylenes yield in an aromatics complex. It is also desirable to provide processes that increase the overall aromatics and xylenes yield in an aromatics complex that also reduce the amount of mass lost to fuel gas, and that shift the chemical equilibrium from benzene production to xylenes production while consuming less hydrogen. It is additionally desirable to provide processes for increasing overall aromatics and xylenes yield, while increasing conversion of toluene into mixed xylenes. Furthermore, other desirable features and characteristics of the present invention will become apparent from the subsequent detailed description of the invention and the appended claims, taken in conjunction with the accompanying drawings and this background of the invention.

SUMMARY OF THE INVENTION

Processes are provided for increasing overall aromatics and xylenes yield in an aromatics complex. In accordance with one exemplary embodiment, the process comprises separating a $C_8$+ aromatics stream from an aromatics-rich reformate, into a $C_8$ aromatics fraction and a $C_9$+ aromatics fraction comprising higher alkyl group-substituted $C_9$ and $C_{10}$ aromatics. The $C_9$+ aromatics fraction is separated into a lighter boiling, higher alkyl-substituted $C_9$ or $C_9/C_{10}$ aromatics fraction and a heavier boiling, $C_{10}$+ or $C_{11}$+ aromatics fraction. The lighter boiling, higher alkyl group-substituted $C_9$ or $C_9/C_{10}$ aromatics fraction are isomerized to convert a portion of the higher alkyl group-substituted $C_9$ or $C_9/C_{10}$ aromatics therein into methyl-enriched $C_9$ or $C_9/C_{10}$ aromatics. The methyl-enriched $C_9$+ stream with the heavier boiling, $C_{10}$+ aromatics fraction. The methyl-enriched $C_9$+ aromatics stream comprising the methyl-enriched $C_9$ aromatics or the methyl-enriched $C_9/C_{10}$ aromatics are transalkylated.

Processes are provided for increasing overall aromatics and xylenes yield in an aromatics complex. In accordance with another exemplary embodiment, the process comprises separating $C_8$+ aromatics, from an aromatics-rich reformate, into a $C_8$ aromatics fraction and a $C_9$+ aromatics fraction comprising higher alkyl group-substituted $C_9$ and $C_{10}$ aromatics. A portion of the higher alkyl group-substituted $C_9$ aromatics is isomerized to produce a methyl-enriched $C_9$+ aromatics stream containing naphthenes. The methyl-enriched $C_9$+ aromatics stream containing naphthenes is separated into a lighter boiling, higher alkyl group-substituted $C_9$ aromatics fraction containing the naphthenes and a heavier boiling, methyl-enriched $C_9$+ aromatics fraction. At least a portion of the lighter boiling, higher alkyl group-substituted $C_9$ aromatics fraction containing the naphthenes is recycled to the isomerizing step. The methyl-enriched $C_9$+ aromatics fraction or a methyl-enriched $C_9/C_{10}$ aromatics fraction is transalkylated with a toluene-containing stream.

Processes are provided for increasing overall aromatics and xylenes yield in accordance with another exemplary embodiment of the present invention. The process comprises isomerizing higher alkyl group-substituted $C_9$ aromatics to convert a portion of the higher alkyl group-substituted $C_9$ aromatics into methyl-enriched $C_9$ aromatics producing an isomerization product comprising a heavier boiling, methyl-enriched $C_9$ aromatics fraction and a lighter boiling, higher alkyl group-substituted $C_9$ aromatics fraction containing naphthenes. The isomerization product is separated into the heavier boiling, methyl-enriched $C_9$ aromatics fraction and the lighter boiling, higher alkyl group-substituted $C_9$ aromatics fraction. The methyl-enriched $C_9$ aromatics fraction combines with a $C_9$+ aromatics fraction to form a methyl-enriched $C_9$+ aromatics fraction. The methyl-enriched $C_9$+ aromatics fraction is transalkylated with a toluene-containing stream.

Processes are provided for increasing overall aromatics and xylenes yield in accordance with yet another exemplary embodiment of the present invention. The process comprises separating $C_8$+ aromatics into a $C_8$ aromatics fraction as a reformate splitter sidecut and a $C_9$+ aromatics fraction from the bottom stream of the reformate splitter. The $C_9$+ aromatics fraction is separated into a $C_{11}$+ aromatics fraction and a $C_9/C_{10}$ aromatics fraction. The $C_9/C_{10}$ aromatics fraction is isomerized to produce an isomerization product comprising methyl-enriched $C_9/C_{10}$ aromatics and naphthenes. The isomerization product is dehydrogenated to convert the naphthenes into aromatics. The isomerization product is transalkylated after the dehydrogenation step with a toluene-containing stream.

BRIEF DESCRIPTION OF THE DRAWINGS

The present invention will hereinafter be described in conjunction with the following drawing figures, wherein like numerals denote like elements, and wherein.

DETAILED DESCRIPTION

Figure 1:
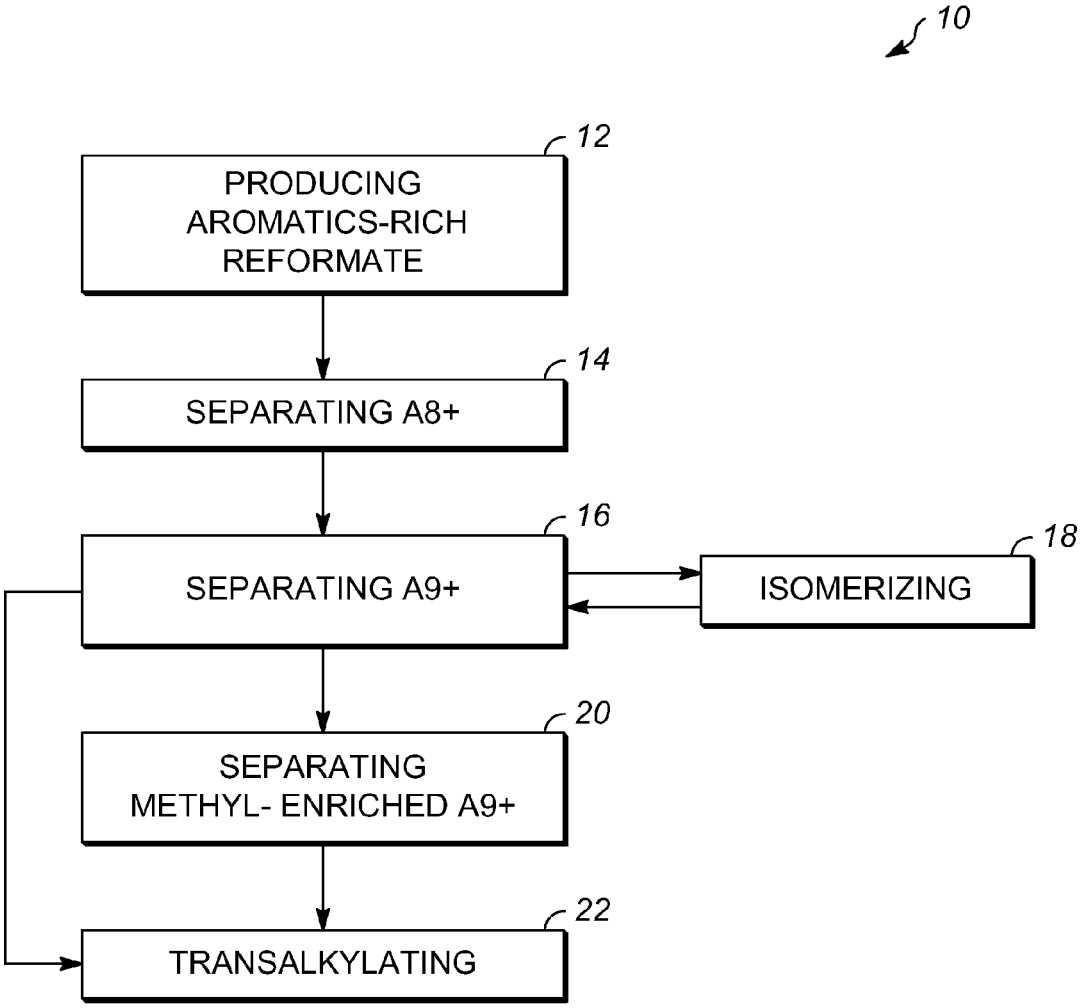
FIG. 1 is a flow diagram of a process for increasing overall aromatics and xylenes yield in an aromatics complex, according to an exemplary embodiment of the present invention.

The following detailed description of the invention is merely exemplary in nature and is not intended to limit the invention or the application and uses of the invention. Furthermore, there is no intention to be bound by any theory presented in the preceding background of the invention or the following detailed description of the invention.

Various embodiments are directed to processes for increasing overall aromatics and xylenes yield in an aromatics complex by isomerizing higher alkyl group-substituted $C_9$ or $C_9$ and $C_{10}$ ($C_9/C_{10}$) aromatics from an aromatics-rich reformate produced from reforming hydrotreated naphtha and pyrolysis gasoline feedstocks. The aromatics-rich reformate is created via high-severity reforming and typically has higher levels of higher alkyl group-substituted aromatic compounds than are seen at equilibrium at lower reformer temperatures. As used herein, "higher alkyl group-substituted aromatics" refers to aromatic compounds having substituted ethyl, propyl, or butyl groups on the aromatic rings. Ethyl, propyl, and butyl groups are collectively referred to herein as "higher alkyl groups". For example, the ethyl groups involved in the isomerization reaction are those $C_9$ or $C_9/C_{10}$ aromatics having at least one ethyl substitute, such as diethylbenzene, methyl-ethylbenzene (ethyl-toluene), or dimethyl ethylbenzene. If the higher alkyl group-substituted $C_9$ or $C_9/C_{10}$ aromatics are passed to the transalkylation process unit without prior isomerization to convert a portion of the higher alkyl groups to methyl groups, the higher alkyl groups on the aromatic rings will be dealkylated, forming liquefied petroleum gas (hereinafter "LPG"), i.e., fuel gas, with a higher benzene yield and lower xylenes yield. As noted previously, "dealkylation" refers to the complete or partial removal of the alkyl group(s). Higher ratios of methyl groups to the higher alkyl groups results in higher xylenes yields. Thus, if the higher alkyl groups are not dealkylated in the transalkylation process unit to LPG (fuel gas), but are isomerized to methyl groups forming trimethylbenzene, for example, before transalkylation, the overall aromatics and xylenes yield increases and the hydrogen consumption decreases. Isomerization conserves the alkyl groups on the aromatic rings by converting them to methyl groups, preventing their dealkylation during a subsequent transalkylatng step. As used herein:

$C_6$– components are $C_1$-$C_6$ alkanes, $C_1$-$C_6$ cycloalkanes, and benzene;

$C_7^-$ aromatics are aromatics having 7 or less carbon atoms ($A_7^-$s);

$C_8$ aromatics are aromatics having 8 carbon atoms ($A_8$s);

$C_8^+$ aromatics are aromatics having 8 or more carbon atoms ($A_8^+$s);

$C_9$ aromatics are aromatics having 9 carbon atoms ($A_9$s);

$C_9^+$ aromatics are aromatics having 9 or more carbon atoms ($A_9^+$s);

$C_{10}$ aromatics are aromatics having 10 carbon atoms ($A_{10}$s)

$C_{10}^+$: aromatics are aromatics having 10 or more carbon atoms ($A_{10}^+$s); and $C_{11}^+$ aromatics are aromatics having 11 or more carbon atoms ($A_{11}^+$).

Figure 2:
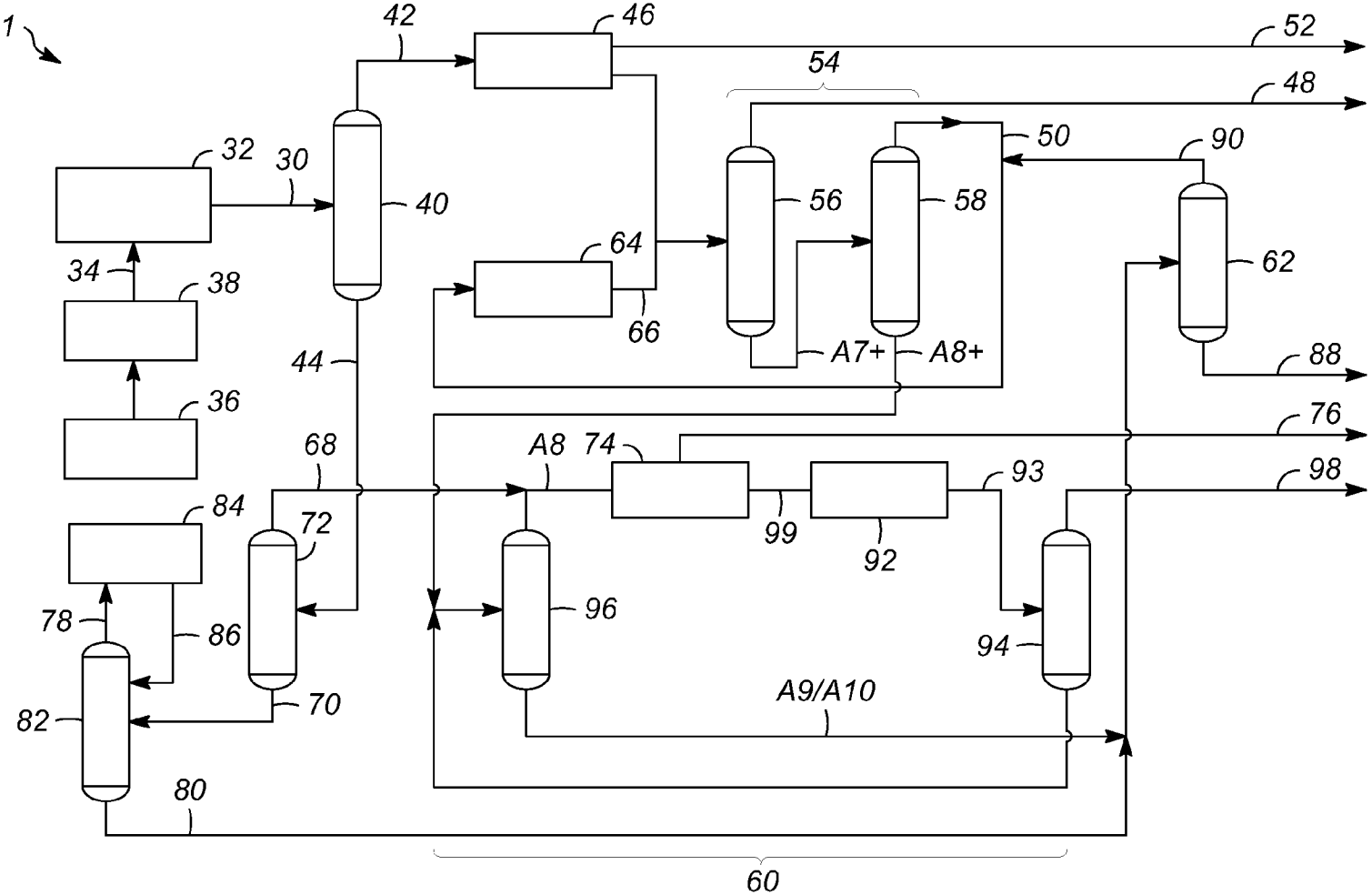
FIG. 2 is a schematic diagram of an aromatics complex for performing the process of FIG. 1 to increase overall aromatics and xylenes yield, according to an exemplary embodiment of the present invention.

Referring to FIGS. 1 and 2, a process 10 for increasing overall aromatics and xylenes yield in an aromatics complex 1 begins by producing an aromatics-rich reformate 30 (step 12). The aromatics-rich reformate 30 is produced from a reforming process, conducted in a reforming unit 32 in the aromatics complex, by selectively reforming hydrotreated naphtha feed 34, as well known in the art. The naphtha feed 36 is hydrotreated in a hydrotreater 38 to remove sulfur and nitrogen from the naphtha feed producing the hydrotreated naphtha feed 34. The aromatics-rich reformate 30 is sent to a reformate splitter column 40 for separation into a $C_7^-$ aromatics fraction 42 and a $C_8^+$ aromatics fraction 44.

As known in the art, the $C_7^-$ aromatics fraction is sent overhead to be subjected to an extractive distillation process in an extraction process unit 46 of the aromatics complex for extraction of benzene 48 and a toluene-containing stream 50 (Liquid-Liquid extraction can also be applied for certain feedstocks). The extraction process unit extracts benzene and toluene from the reformate splitter column overhead (the $C_7$– aromatics fraction) and rejects an aromatics-free raffinate stream 52, which can be further refined into paraffinic solvents, blended into gasoline, or used as feedstock for an ethylene plant. The aromatics extract is treated to remove trace olefins, and individual high purity benzene and toluene products are recovered in a benzene-toluene fractionation section (hereinafter "BT fractionation section") 54 of the aromatics complex. The BT fractionation section 54 includes a benzene column 56 and a toluene column 58. Benzene 48 is recovered as a stream from an upper section of the benzene column with $C_7^+$ material flowing from the benzene column bottom stream to the toluene column. $A_8^+$ aromatics from the bottom stream of the toluene column are sent to a xylenes column 96 at a front end of a xylenes recovery section 60 of the aromatics complex.

Referring again to FIGS. 1 and 2, the process 10 continues by separating the $C_8$+ aromatics fraction ($A_8$+) 44 from the reformate splitter into a $C_8$ aromatics fraction 68 (a lighter aromatics fraction) and a $C_9$+ aromatics fraction 70 (a heavier aromatics fraction) (step 14). Referring to FIG. 2, the $C_8$+ aromatics fraction 44 from the bottom stream of the reformate splitter is separated in a fractionation column 72 into the $C_8$ aromatics fraction 68 and the $C_9$+ aromatics fraction 70. The $C_8$ aromatics fraction 68 is passed to a para-xylene recovery process unit 74 in the xylenes recovery section 60 of the aromatics complex for recovery of para-xylene 76, as hereinafter described.

Referring still to FIGS. 1 and 2, process 10 continues by separating the $C_9$+ aromatics fraction ($A_9$+) 70, via a $C_9$ splitter column 82, into lighter boiling and heavier boiling fractions 78 and 80, respectively (step 16). Referring to FIG. 2, the lighter boiling fraction 78 comprises higher alkyl group-substituted $C_9$ aromatics which are passed overhead to an isomerization reactor 84 as hereinafter described. The heavier boiling fraction 80 comprises $C_9$ aromatics having a greater number of methyl substitutes than the lighter boiling fraction, such as trimethylbenzene, methyl-enriched $C_9$ aromatics as hereinafter described, and $C_{10}$+ aromatics (collectively referred to hereinafter as "methyl-enriched $C_9$+ aromatics"). The $C_9$ splitter column 82 may be a distillation column.

As well known in the art, separation of a multicomponent feed in a distillation column may not result in a perfect separation of the desired components. For example, a small portion of the desired heavy feed components may be present in the overhead product stream and a small portion of the desired light feed components may be present in the bottom product stream. For example, the lighter boiling overhead stream 78 from the $C_9$ splitter column 82 comprises substantially all higher alkyl group-substituted $C_9$ aromatics. The heavier boiling bottom stream 80 from the $C_9$ splitter column 82 comprises substantially all $C_9$+ aromatics having a greater amount of methyl substitutes. As used herein, the term "substantially all" can mean an amount generally of at least 90%, preferably at least 95%, and optimally at least 99%, by weight, of a compound or class of compounds in a stream.

Still referring to FIGS. 1 and 2, process 10 continues by isomerizing a portion of the lighter boiling, higher alkyl group-substituted $C_9$ aromatics 78 under isomerization conditions to produce an isomerization product 86 comprising the methyl-enriched $C_9$ aromatics fraction, residual higher alkyl group-substituted $C_9$ aromatics, and naphthenes (step 18). Isomerization conditions include a temperature range of about 250° C. to about 450° C. and a pressure range of about 3 bar to about 15 bar, using an isomerization catalyst. Isomerization catalysts are well known in the art. The term "isomerization" is used herein to describe the conversion of an aromatic hydrocarbon into at least one different aromatic hydrocarbon product having the same number of carbon atoms. Isomerization desirably converts those aromatics having at least one ethyl, propyl, or butyl substitute, such as methyl-ethylbenzene and propyl benzene into trimethylbenzene. The availability of additional methyl groups from the $C_9$ aromatics, as a result of the isomerization step, shifts the transalkylation step chemical equilibrium from benzene production to xylenes production. In addition, the methyl groups on the $C_9$ aromatic rings are highly stable at transalkylation reaction conditions and are essentially conserved in the transalkylation reaction. Therefore, the overall aromatics and xylenes yield increases and hydrogen consumption decreases as the number of available ethyl, propyl and butyl groups available to be dealkylated in a subsequent transalkylating step is reduced.

As known in the art, naphthene bridges allow conversion of the $C_9$ aromatics to different isomers during isomerization, yielding certain fractions of naphthenes in the isomerization product. The isomerization catalyst incorporates an acid function to promote naphthene ring transformation from cyclohexanes to cyclopentanes and back again and a metal function to promote the equilibrium amount of naphthenes to enable substituted ethyl, propyl, and butyl group isomerization to substituted methyl groups, i.e, the ethyl, propyl, and butyl groups on the $C_9$ aromatic rings are isomerized to an equilibrium amount of methyl groups.

The isomerization product 86 is continuously recycled to the $C_9$ splitter column 82 for separation into the lighter and heavier boiling fractions, with the residual lighter boiling, higher alkyl group-substituted $C_9$ aromatics fraction continuously recycled back to the isomerization reactor for conversion of a portion of the higher alkyl groups to methyl groups. Thus, the separation and isomerization steps are continuously repeated forming a recycle loop, relieving an equilibrium limited reaction. In addition, the naphthenes formed during isomerization boil lighter than the other $C_9$ aromatics, thereby also becoming part of the recycle loop, sequestering them from the rest of the aromatics complex. Such sequestration avoids additional yield losses that would otherwise be caused by naphthenes cracking into LPG during subsequent transalkylation.

The methyl-enriched $C_9$ aromatics fraction of the separated isomerization product becomes part of the heavier boiling, methyl-enriched C9+ aromatics 80 that are passed from the $C_9$ splitter column to a heavy aromatics column 62, after blending with $A_9/A_{10}$ from the bottom stream of the xylenes column 96. As used herein, the term "heavies" refers to $C_9$+ aromatics. The methyl-enriched $C_9$+ aromatics 80 are separated into a $C_{11}$+ aromatics fraction 88 from the bottom stream of the heavy aromatics column and a methyl-enriched $C_9/C_{10}$ aromatics fraction 90 from the overhead thereof (step 20). The methyl-enriched $C_9/C_{10}$ aromatics fraction 90 is sent to a transalkylation process unit 64, after blending with a toluene-containing stream 50 from the overhead of the toluene column 58 in the BT fractionation section 54 of the aromatics complex. It is to be appreciated that this separation (step 20) of the $C_9$+ aromatics into $C_{11}$+ aromatics and methyl-enriched $C_9/C_{10}$ aromatics before transalkylation is optional if a heavy aromatics tolerant transalkylation catalyst is used, in which case the methyl-enriched $C_9$+ aromatics 80 are passed from the $C_9$ splitter column 82 to the transalkylation process unit 64, after blending with the toluene-containing stream 50 from the overhead of the toluene column in the BT fractionation section of the aromatics complex (not shown in FIG. 2).

The process 10 continues by transalkylating the methyl-enriched $C_9/C_{10}$ aromatics fraction (or the methyl-enriched $C_9$+ aromatics if separation step 20 is not performed) with the toluene-containing stream (step 22). Transalkylation effluent 66 is sent to a stripper column (not shown) within the transalkylation process unit to remove light ends, and then recycled to the BT fractionation section 54. As used herein, the term "light ends" refers to $C_6$− compounds, as previously defined. The transalkylation process unit 64 disproportionates toluene into benzene and mixed xylenes and transalkylates the methyl-enriched $C_9/C_{10}$ aromatics (or methyl-enriched $C_9$+ aromatics) with the toluene-containing stream into xylenes and benzene, as known in the art. The overhead material (not shown) from the stripper column is separated into gas and liquid products. The overhead gas (not shown) is exported to a fuel gas system, and the overhead liquid is typically recycled back to the extraction unit 46 for recovery of residual benzene (not shown in FIG. 2). The mixed xylenes are then processed in the xylenes recovery section to produce one or more of the individual xylene isomers, including para-xylene.

In the xylenes recovery section 60 of the aromatics complex, as known to one skilled in the art, the already-separated $C_8$ aromatics fraction 68 is processed to produce para-xylene 76 in the para-xylene recovery process unit, as previously noted. The separated $C_8$ aromatics fraction is fed into the para-xylene recovery process unit 74. Raffinate 99 from the para-xylene recovery process unit 74 is almost entirely depleted of para-xylene. The raffinate is sent to another isomerization process unit 92, where additional para-xylene is produced by re-establishing an equilibrium distribution of xylene isomers, as known to one skilled in the art. Other aromatics are also produced, in a lesser amount than para-xylene, in the isomerization process unit 92. Effluent 93 from the isomerization process unit 92 is sent to a deheptanizer column 94. The bottom stream from the deheptanizer column comprises $C_7$+ aromatics (primarily mixed xylenes). The bottom stream from the deheptanizer column is recycled back to the xylenes column 96 at a front end of the xylenes recovery section of the aromatics complex, after blending with the A8+ aromatics from the bottom stream of the toluene column. The $C_9/C_{10}$ aromatics from the bottom stream of the xylenes column is passed to the heavy aromatics column 62, after blending with the methyl-enriched $C_9$+ aromatics 80 from the $C_9$ splitter column 82, as previously noted. The $C_8$ aromatics 68 from the overhead of the xylenes column is passed to the para-xylene recovery process unit 74 and processed to para-xylene, as previously described. In this way, all the $C_8$ aromatics are continually recycled within the xylenes recovery section of the complex until they exit the aromatics complex as para-xylene or benzene. The overhead stream 98 from the deheptanizer column is split into gas and liquid products. The overhead gas 98 is exported to the fuel gas system and the overhead liquid (not shown) is normally recycled back to the extraction unit 46 for recovery of residual benzene (not shown in FIG. 2).

Figure 3:
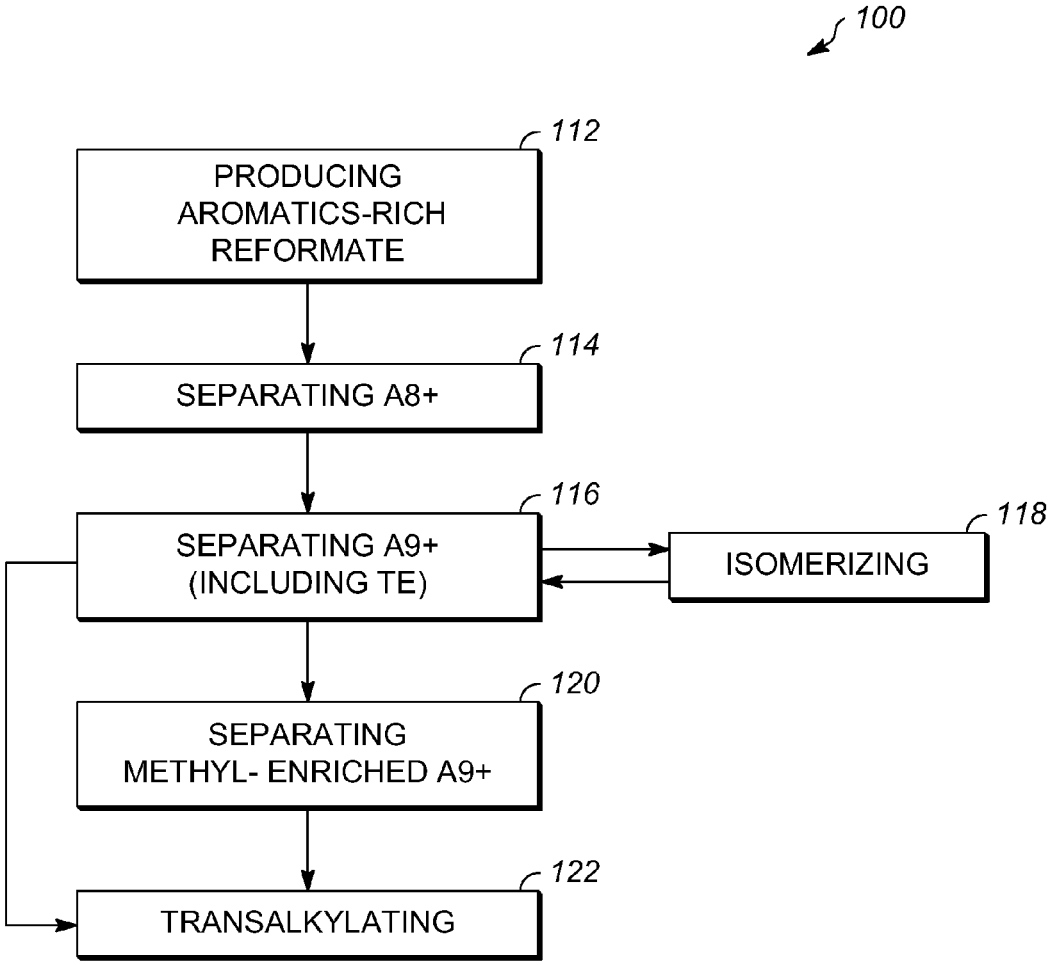
FIG. 3 is a flow diagram of a process for increasing overall aromatics and xylenes yield in an aromatics complex, according to another exemplary embodiment of the present invention.
Figure 4:
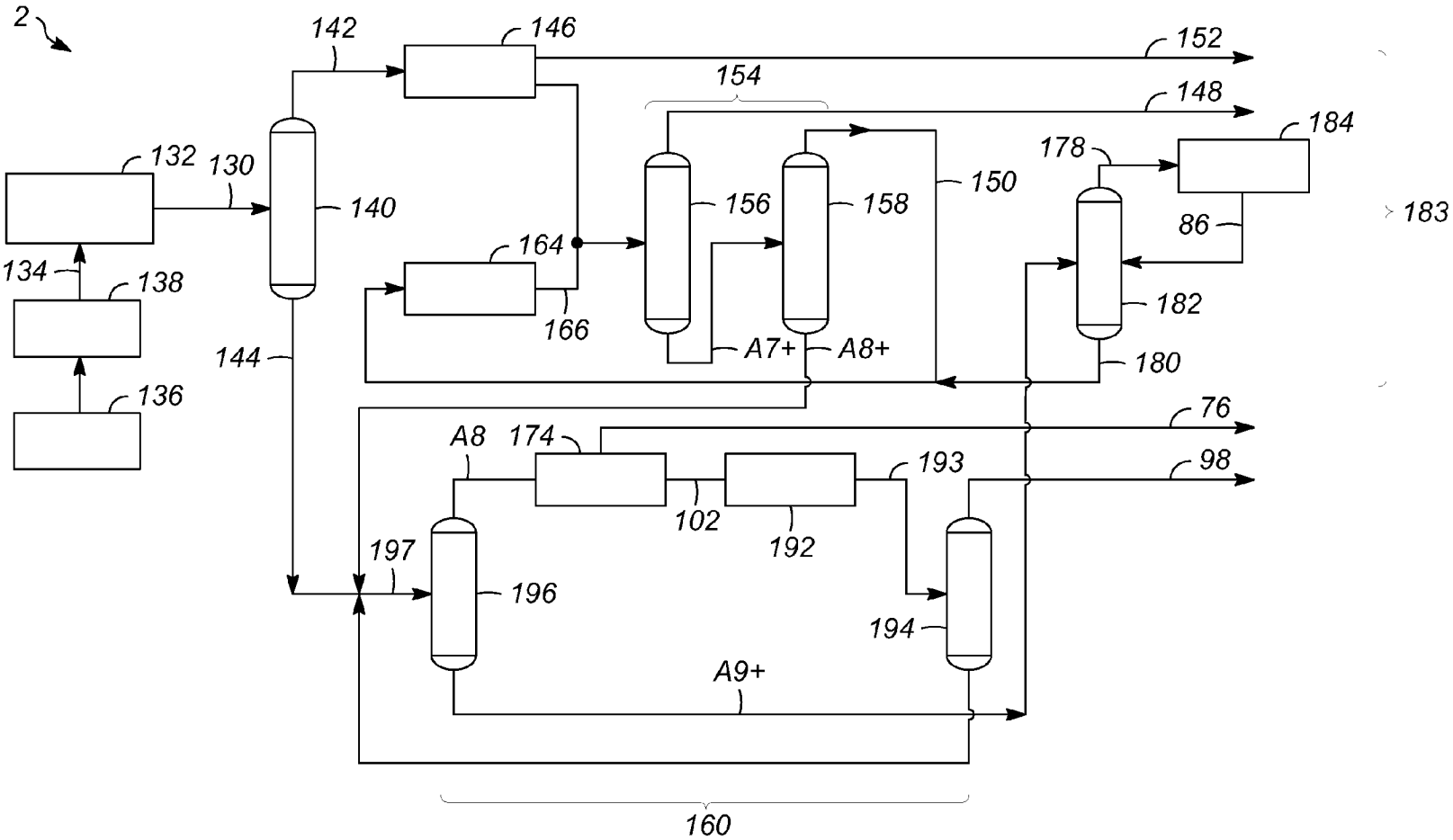
FIG. 4 is a schematic diagram of an aromatics complex for performing the process of FIG. 3 to increase overall aromatics and xylenes yield, according to another exemplary embodiment of the present invention.

In accordance with another embodiment as illustrated in FIGS. 3 and 4, a process 100 for increasing overall aromatics and xylenes yield in an aromatics complex 2 begins in the same manner by providing an aromatics-rich reformate 130 (step 112) by reforming hydrotreated naphtha 134 in a reforming unit 132. The hydrotreated naphtha is produced from naphtha feed 136 subjected to hydrotreating in a hydrotreater 138 to remove sulfur and nitrogen in the same manner as previously described. The aromatics-rich reformate 130 is sent to a reformate splitter column 140 for separation into an overhead $C_7$—aromatics fraction 142 and a bottom $C_8$+ aromatics fraction 144. The overhead $C_7$—aromatics fraction 142 is processed in the same manner as overhead $C_7$− aromatics fraction 42 discussed above with respect to FIG. 2. In particular, as known in the art, the $C_7^-$ aromatics fraction 142 is sent overhead to be subjected to an extractive distillation process in an extraction process unit 146 of the aromatics complex 2 for extraction of benzene 148 and toluene in a toluene-containing stream 150 (Liquid-Liquid extraction can also be applied for certain feedstocks). The extraction process unit extracts benzene and toluene from the reformate splitter column overhead (the $C_7$− aromatics fraction) and rejects an aromatics-free raffinate stream 152, which can be further refined into paraffinic solvents, blended into gasoline, or used as feedstock for an ethylene plant. The aromatics extract is treated to remove trace olefins, and individual high purity benzene and toluene products are recovered in a BT fractionation section 154 of the aromatics complex. The BT fractionation section 154 includes a benzene column 156 and a toluene column 158. Benzene 148 is recovered as an overhead stream from the benzene column with $C_7^+$ material flowing from the benzene column bottom stream to the toluene column. $C_8$+ aromatics ($A_8^+$) from the bottom stream of the toluene column is sent to a xylenes column 196 at a front end of a xylenes recovery section 160 of the aromatics complex.

The bottom stream $C_8$+ aromatics fraction 144 is also passed to the xylenes column 196, after blending with the $A_8^+$ aromatics from the bottom stream of the toluene column 158. The combined $C_8$+ aromatics fraction 197 is separated into a $C_8$ aromatics fraction and a $C_9$+ aromatics fraction in the xylenes column (step 114). The $C_8$ aromatics fraction ($A_8$) from the overhead of the xylenes column is sent to a para-xylene recovery process unit 174 for recovery of para-xylene, in the same manner as previously described for para-xylene recovery process unit 74 of FIG. 2. More specifically, raffinate 102 from the para-xylene recovery process unit 174 is almost entirely depleted of para-xylene. The raffinate is sent to another isomerization process unit 192, where additional para-xylene is produced by re-establishing an equilibrium distribution of xylene isomers, as known to one skilled in the art. Effluent 193 from the isomerization process unit 192 is sent to a deheptanizer column 194. The bottom stream from the depheptanizer column, comprised of C7+ aromatics (primarily mixed xylenes) is recycled back to the xylenes column 196 at a front end of the xylenes recovery section of the aromatics complex, after blending with the $A_8$+ aromatics from the bottom stream of the toluene column.

The $C_9$+ aromatics fraction from the bottom stream of the xylenes column, comprising a mixture of dealkylated $C_9$+ aromatics from the transalkylation effluent (TE) 166 (via the A8+ aromatics from the bottom stream of the toluene column 158) and higher alkyl group-substituted $C_9$+ aromatics from the reformate, is passed to the $C_9$ splitter column 182, now at the back end of an aromatics fractionation section 183 of the aromatics complex, for separation into the lighter and heavier boiling components 178 and 180, respectively (step 116). The lighter boiling components from the $C_9$ splitter column are continuously recycled in the recycle loop through the isomerization reactor 184 (step 118) and isomerized to convert a portion of the higher alkyl group-substituted $C_9$ aromatics into methyl-enriched $C_9$ aromatics which become part of the heavier boiling, $C_9$+ aromatics (collectively referred to as "methyl-enriched $C_9$+ aromatics") 180. The naphthenes are isolated from the rest of the aromatics complex in the recycle loop in the same manner as previously described.

Referring still to FIGS. 3 and 4, the methyl-enriched $C_9$+ fraction 180 from the $C_9$ splitter column may be passed to the transalkylation process unit 164, after blending with the toluene-containing stream 150 from the overhead of the toluene column, and transalkylated using a heavy aromatics tolerant transalkylation catalyst to produce xylenes and benzene (step 122). It is to be understood that if a heavy aromatics tolerant transalkylation catalyst is not used, and as previously described and illustrated in FIGS. 1 and 2, the methyl-enriched $C_9$+ aromatics 180 may be passed from the $C_9$ splitter column 182 to a heavy aromatics column (not shown in FIG. 4) for separation (step 120) into a $C_{11}$+ aromatics fraction from the bottom stream of the heavy aromatics column and a $C_9/C_{10}$ aromatics fraction from the overhead thereof before sending the $C_9/C_{10}$ aromatics fraction to the transalkylation process unit 164, after blending with the toluene-containing stream 150 from the overhead of the toluene column 158 in the BT fractionation section 154 of the aromatics complex. The $C_9/C_{10}$ aromatics fraction is transalkylated.

Isomerization of the $C_9$+ aromatics from a combination of the transalkylation effluent and reformate has the advantage that the $C_9$+ aromatics are separated from the $C_8$ aromatics in the xylenes column, eliminating the distillation column 72 used in process 10. The elimination of the separation in the distillation column helps offset the increased energy consumption needed to separate the trimethylbenzene on the one hand and the propyl benzene and methyl-ethyl benzene on the other in the $C_9$ splitter column. The trimethylbenzene concentration of the transalkylation effluent $C_9$ aromatics limits the thermodynamic driving force available for the isomerization reaction. To drive the isomerization reaction in processes 10 and 100, the propyl benzene and methyl-ethylbenzene in the mixture sent to the isomerization reactor are enriched in the $C_9$ splitter column.

Figure 5:
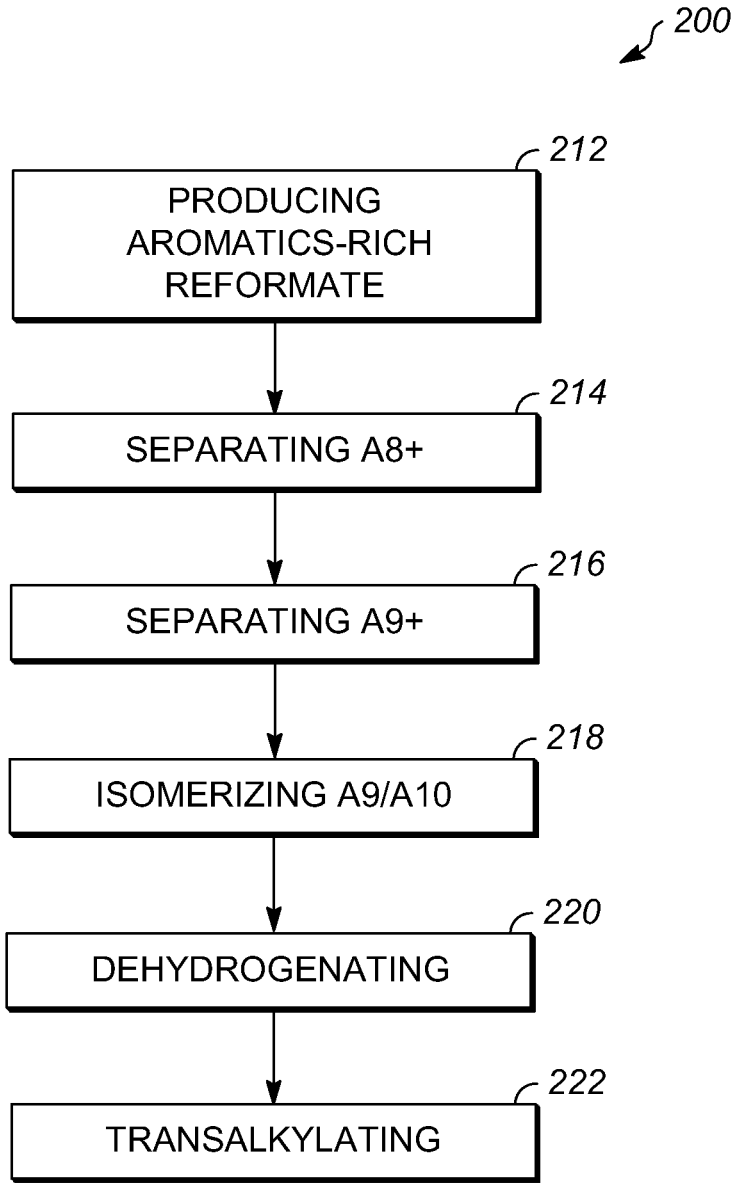
FIG. 5 is a flow diagram of a process for increasing overall aromatics and xylenes yield in an aromatics complex, according to yet another exemplary embodiment of the present invention.
Figure 6:
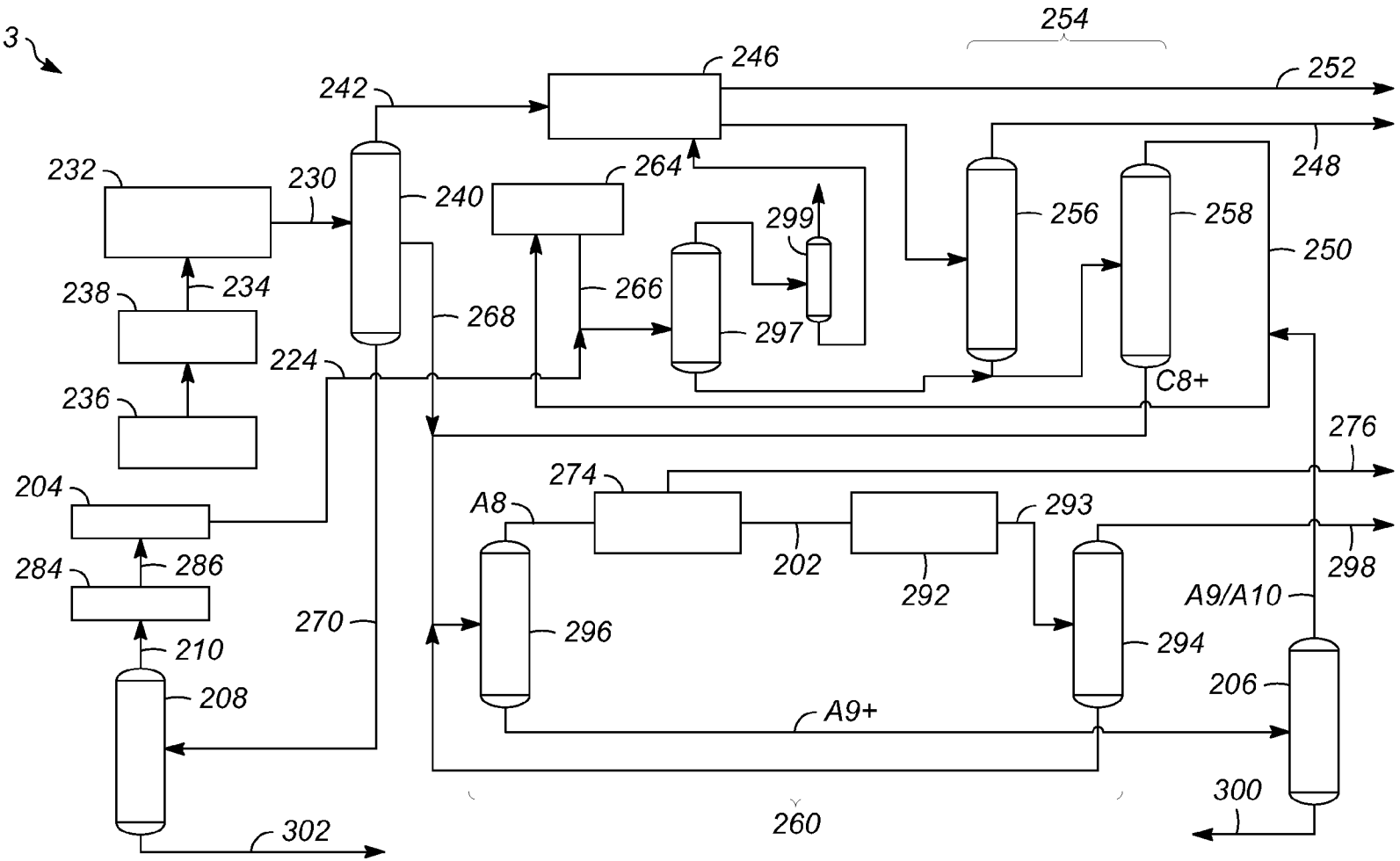
FIG. 6 is a schematic diagram of an aromatics complex for performing the process of FIG. 5 to increase overall aromatics and xylenes yield, according to yet another exemplary embodiment of the present invention.

In accordance with yet another exemplary embodiment, as illustrated in FIGS. 5 and 6, a process 200 for increasing overall aromatics and xylenes yield in an aromatics complex 3 begins by producing an aromatics-rich reformate 230 (step 212). The aromatics-rich reformate 230 is produced from reforming hydrotreated naphtha feed in a reforming unit 232. Naphtha feed 236 is hydrotreated in a hydrotreater 238 to produce the hydrotreated naphtha 234. The $C_8$+ aromatics-rich reformate is separated (step 214) in a reformate splitter 240 with a $C_7$− aromatics fraction 242 from the overhead thereof, a $C_8$ aromatics fraction 268 as a sidecut from the reformate splitter, and a $C_9$+ aromatics fraction 270 from the bottom stream of the reformate splitter. The $C_7$− aromatics fraction 242 is sent overhead to be subjected to an extractive distillation process in an extraction process unit 246 of the aromatics complex 3 for extraction of benzene 248 and toluene in a toluene-containing stream 250 (Liquid-Liquid extraction can also be applied for certain feedstocks). The extraction process unit extracts benzene and toluene from the reformate splitter column overhead (the $C_7$− aromatics fraction) and rejects an aromatics-free raffinate stream 252, which can be further refined into paraffinic solvents, blended into gasoline, or used as feedstock for an ethylene plant. The aromatics extract is treated to remove trace olefins, and individual high purity benzene and toluene products are recovered in a BT fractionation section 254 of the aromatics complex. The BT fractionation section 254 includes a benzene column 256 and a toluene column 258. Benzene 248 is recovered as a stream from an upper section of the benzene column with $C_7^+$ material flowing from the benzene column bottom stream to the toluene column. $C_8$+ aromatics ($A_8^+$) from the bottom stream of the toluene column are sent to a xylenes column 296 at a front end of a xylenes recovery section 260 of the aromatics complex. In accordance with an exemplary embodiment, the BT fractionation section of the aromatics complex includes secondary and tertiary benzene columns 297 and 299, for purposes as hereinafter described.

The $C_8$ aromatics fraction 268 is combined with $C_8$+ aromatics from the bottom stream of a toluene column 258 in the BT recovery section of the aromatics complex before entering the xylenes column 296. The $C_8$ aromatics fraction ($A_8$) from the overhead of the xylenes column is passed to a para-xylene recovery process unit 274 for recovery of para-xylene 276. Raffinate 202 from the para-xylene recovery process unit 274 is almost entirely depleted of para-xylene. The raffinate is sent to another isomerization process unit 292, where additional para-xylene is produced by re-establishing an equilibrium distribution of xylene isomers, as known to one skilled in the art. Effluent 293 from the isomerization process unit 292 is sent to a deheptanizer column 294. The bottom stream from the deheptanizer column, comprising $C_7$+ aromatics (primarily mixed xylenes) is recycled back to the xylenes column 296.

The $C_9$+ aromatics from the bottom stream of the xylenes column are passed to a first heavy aromatics column 206 for separation into a $C_{11}$+ aromatics fraction 300 which is removed from the aromatics complex and a $C_9/C_{10}$ aromatics fraction ($A_9/A_{10}$) which is passed to the transalkylation process unit 264, after blending with the toluene-containing stream 250 from the overhead of the toluene column 258.

The $C_9$+ aromatics fraction 270 from the bottom of the reformate splitter 240 is separated (step 216) in a second heavy aromatics distillation column 208 into a $C_{11}$+ aromatics fraction, which is removed from the aromatics complex and a $C_9/C_{10}$ aromatics fraction 210. The $C_9/C_{10}$ aromatics fraction 210 is then isomerized in an isomerization reactor 284 in the same manner as previously described, converting at least a portion of the higher alkyl group-substituted $C_9/C_{10}$ aromatics into methyl-rich $C_9/C_{10}$ aromatics to produce an isomerization product 286 comprising the methyl-enriched $C_9/C_{10}$ aromatics fraction and $C_9$ and $C_{10}$ naphthenes (step 218). The reforming equilibrium $A_9$s consist of 11% higher alkyl groups that are cracked to fuel gas, if not subjected to the isomerization step. The reforming equilibrium $A_{10}$s have 19% higher alkyl groups that are cracked to fuel gas, if not subjected to the isomerization step. Therefore, the reduction in the amount of mass lost to fuel gas in the aromatics complex and hydrogen consumed per $A_{10}$ is almost double, on a mass fed basis, by including $C_{10}$ aromatics in the feed to the isomerization reactor.

In accordance with an exemplary embodiment, as illustrated in FIGS. 5 and 6, the isomerization product 286 is then passed directly to a dehydrogenation reactor 204 under dehydrogenation conditions to dehydrogenate at least a portion of the $C_9$ and $C_{10}$ naphthenes therein into aromatics (step 220). Dehydrogenation conditions are well known to one skilled in the art. The dehydrogenated isomerized product 224 may contains non-aromatics (e.g., unreacted naphthenes, etc.) which dilute the benzene in the aromatics complex.

Referring to FIG. 6, in an embodiment, the dehydrogenated isomerized product 224 is combined with transalkylation effluent 266 and passed to secondary and tertiary benzene columns 297 and 299 to re-extract benzene. The secondary benzene column 297 lifts benzene overhead and sends the toluene-containing stream to the bottom stream thereof, as opposed to the typical stripper operation that just lifts $C_6$− components. As the overhead is still too volatile to send directly to the extraction unit 246, the overhead material is subjected to further stripping in the tertiary benzene column 299. The bottom stream from the tertiary benzene column 299 is sent to the extraction unit 246, and then through the BT fractionation section 254, before transalkylating (step 222) the methyl-enriched $C_9/C_{10}$ aromatics into benzene and xylenes in the transalkylation unit 264. The xylenes are further processed in the xylenes recovery section 260 of the aromatics complex as known in the art. It is to be understood that if the dehydrogenated isomerized product 224 is passed directly to the transalkylation unit (not shown in FIG. 6) without benzene re-extraction in the secondary and tertiary benzene columns as described above, some cracking of the non-aromatics may occur.

While processes for increasing overall aromatics and xylenes yield beginning with an aromatics-rich reformate produced from hydrotreated naphtha have been described, it is to be understood that these processes may also be used to increase overall aromatics and xylenes yield from pyrolysis gasoline containing higher alkyl group-substituted $C_9$ and $C_9/C_{10}$ aromatics. The pyrolysis gasoline may be hydrotreated in a pyrolysis gasoline hydrotreater (not shown) to form hydrotreated pyrolysis gasoline. The hydrotreated pyrolysis gasoline may be combined with the aromatics-rich reformate 30 (FIG. 2) passed into the reformate splitter, and the aromatics-rich reformate (now combined with hydrotreated pyrolysis gasoline) processed in the same manner previously described. It is also to be understood that while conventional fractionation columns have been described, other separation methods may be used. From the foregoing, it is to be appreciated that the exemplary embodiments of the process described herein increase overall aromatics and xylenes yield and reduce the amount of mass lost to fuel gas, and shift the chemical equilibrium from benzene production to xylenes production while reducing hydrogen consumption.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for increasing overall aromatics and xylenes yield in an aromatics complex, the process comprising the steps of:

separating a $C_8$+ aromatics stream from an aromatics-rich reformate into a $C_8$ aromatics fraction and a $C_9$+ aromatics fraction comprising higher alkyl group-substituted $C_9$ and $C_{10}$ aromatics;

separating the $C_9$+ aromatics fraction into a lighter boiling, higher alkyl group-substituted $C_9$ or $C_9/C_{10}$ aromatics fraction and a heavier boiling, $C_{10}$+ or $C_{11}$+ aromatics fraction;

isomerizing the lighter boiling, higher alkyl group-substituted $C_9$ or $C_9/C_{10}$ aromatics fraction to convert a portion of the higher alkyl group-substituted $C_9$ or $C_9/C_{10}$ aromatics therein into methyl-enriched $C_9$ or $C_9/C_{10}$ aromatics; and transalkylating a methyl-enriched $C_9$+ aromatics stream comprising the methyl-enriched $C_9$ aromatics or the methyl-enriched $C_9/C_{10}$ aromatics with a toluene containing stream to produce a product containing xylenes.

2. The process of claim 1, wherein the step of transalkylating the methyl-enriched $C_9$+ aromatics stream comprises transalkylating with a heavy aromatics-tolerant catalyst.

3. The process of claim 1, wherein the step of isomerizing comprises using an isomerization catalyst and isomerizing at a temperature range of about 250° C. to about 450° C. and a pressure range of about 3 bar to about 15 bar.

4. The process of claim 1, further comprising the steps of:

separating the methyl-enriched $C_9$+ aromatics stream into a methyl-enriched $C_9/C_{10}$ aromatics stream and a $C_{11}$+ aromatics stream; and transalkylating the methyl-enriched $C_9/C_{10}$ aromatics stream.

* * * * *